US005749341A

United States Patent [19]

Hosaka et al.

[11] Patent Number: 5,749,341

[45] Date of Patent: May 12, 1998

[54] VALVE LIFTER FOR INTERNAL COMBUSTION ENGINES

[75] Inventors: Noriomi Hosaka; Tadashi Kikyohara; Seiji Tsuruta, all of Kanagawa; Sadayuki Abo; Masaki Toriumi, both of Yokohama; Kenji Ariga, Kanagawa, all of Japan

[73] Assignees: Unisia Jecs Corporation, Atsugi; Nissan Motor Co., Ltd., Yokohama, both of Japan

[21] Appl. No.: 839,176

[22] Filed: Apr. 23, 1997

[30] Foreign Application Priority Data

Apr. 23, 1996 [JP] Japan ..... 8-100912

[51] Int. Cl.[6] ..... F01M 9/10; F01L 1/16

[52] U.S. Cl. ..... 123/90.35; 123/90.52

[58] Field of Search ..... 123/90.33, 90.35, 123/90.48, 90.49, 90.52, 196 M; 184/6.5, 6.9

[56] References Cited

U.S. PATENT DOCUMENTS 3,301,239 1/1967 Thauer ..... 123/90.52
5,566,652 10/1996 Deppe ..... 123/90.35
5,570,665 11/1996 Regueiro ..... 123/90.52

FOREIGN PATENT DOCUMENTS 57-200609 6/1956 Japan .
59-170603 11/1984 Japan .
60-164611 11/1985 Japan .

*Primary Examiner*—Weilun Lo
*Attorney, Agent, or Firm*—Foley & Lardner

[57] ABSTRACT

A mechanical valve lifter for an internal combustion engine comprises a head section having a recessed portion on an upper face thereof, a skirt section formed integral with the head section and adapted to be in sliding-contact with a lifter guiding bore in an engine cylinder head, a mechanical valve-clearance adjusting shim put in the recessed portion, an annular groove formed in an upper face of a bottom wall of the recessed portion of the lifter body, a first through-opening formed in the shim to communicate with the annular groove, and a second through-opening formed in the head section to communicate with the annular groove and to penetrate the head section. The annular groove and the second through-opening are formed in an essentially zero bending moment area midway between a central axis of the head section and a peripheral wall of the recessed portion.

10 Claims, 9 Drawing Sheets

VALVE LIFTER FOR INTERNAL COMBUSTION ENGINES

BACKGROUND OF THE INVENTION

1. Field of the Invention

The present invention relates to a valve lifter in a valve mechanism, called a valve train, for an internal combustion engine, and specifically to a solid valve lifter having a mechanical valve-clearance adjustment and an oil-passageway structure for supplying lubricating oil between metal surfaces (such as the end surface of the valve stem of intake or exhaust valves and the wall surface of a hollow lifter body of the solid valve lifter) in contact.

2. Description of the Prior Art

In recent years, there have been proposed and developed various mechanical valve lifters of valve trains for internal combustion engines. As is generally known, the valve lifter is a device which follows the camshaft's cam contour and converts a cam geometry into up-down motion in the valve train. For this reason, the shape and weight of the valve lifter must be as small as possible. To convert the rotating motion of the camshaft into the reciprocating motion of exhaust or intake valves, the valve lifter is usually placed between the cam on the camshaft and the valve stem. An engine lubrication system supplies moving engine parts with lubricating oil to prevent actual metal-to-metal contact between any moving metal surfaces with a film of oil therebetween. The engine lubrication system of course supplies lubricating oil to the contact area between the cam and the valve lifter. In case of solid valve lifters, called mechanical valve lifters, some of the lubricating oil fed into the moving metal surfaces between the cam and the valve lifter is used for lubrication of the contact area between the valve stem and the valve lifter by means of oil passages formed in the valve lifter. This type of valve lifter with oil passages for lubrication between the valve stem and the valve lifter, has been disclosed in Japanese Utility-Model Provisional Publication Nos. 57-200609 and 60-164611. FIG. 13 shows a conventional valve lifter structure similar to a solid valve lifter disclosed in the Japanese Utility-Model Provisional Publication No. 57-200609. As seen in FIG. 13, the prior art valve lifter 1 is an essentially cylindrical hollow lifter body 2 with a lifter head section 3. The lifter head section 3 has a bottom wall 13 and is formed with a circular recessed portion 4 which is defined by the bottom wall 13 and an inner peripheral wall surface of an essentially cylindrical lifter skirt section 14. For the purpose of mechanical valve-clearance adjustment, a substantially disc-like shim 5 of a desired thickness is put into the recessed portion 4. The valve lifter 1 is formed with an annular groove 15 so that the groove 15 extends circumferentially along the inner peripheral wall surface of the lifter skirt section 14. The valve lifter is also formed with an axial through-opening 6 so that the through-opening 6 axially extends in the lifter head section 3 through a portion of the annular groove 15 and along the inner peripheral wall surface of the skirt section 14 to penetrate upper and lower surfaces of the lifter head section 3. The disc-like valve-clearance adjusting shim 5 is formed at its edge with a plurality of essentially semi-spherical cut-outs 10 functioning as oil passages, such that the cut-outs 10 communicate with the axial through-opening 6 through the annular groove 15. With the previously-noted prior art valve lifter arrangement, some of lubricating oil fed from the engine lubrication system to the cam journals and the cam 7 on the camshaft drops onto the upper surface of the shim 5. The oil on the shim 5 drops down into the cut-outs 10 and then flows through the annular groove 15 via the axial through-opening 6 toward the lower surface of the lifter head section 3. In this manner, almost the oil passed from the upper side of the lifter head section 3 to the lower side, flows along an essentially frusto-conical tapered lower surface of the lifter head section 3 toward the central contact area between the valve stem 9 of an intake or exhaust valve 8 and the valve lifter, to form a film of lubricating oil on the contacting surface of the valve stem and valve lifter and consequently to prevent actual metal-to-metal contact, and whereby undesired seizure which would take place at the contacting surface of the valve stem and valve lifter can be avoided. The oil film is also effective to reduce noise of the valve train, undue stem wear or lifter wear, and friction between the lifter and the valve stem during operation. In the valve lifter structure described in the Japanese Utility-Model Provisional Publication No. 57-200609, as appreciated from valve-train component parts, coaxially aligned on the center line (corresponding to the central axis of the valve stem 9) denoted by O and indicated by a one-dotted line in FIG. 13, when pushing down the valve stem 9 with rotation of the cam 7, the lifter head section 3 of the lifter 1 locally receives a very large compression force in and around the center thereof by the cam surface of the cam 7 and the valve-stem end biasing the lifter towards the cam by way of the valve spring. Also, the outer peripheral wall surface of the cylindrical skirt section 14 receives a sliding resistance by the inner peripheral wall of a cylindrical lifter guiding bore 12 formed in the engine cylinder head 11, during the engine operation. For these reasons, there is a tendency for the greatest bending moment or the greatest bending stress to act on the center of the bottom wall 13 of the recessed portion 4 and on the boundary section circumferentially extending between the inner periphery of the lifter skirt section 14 and the outer periphery of the lifter head section 3. In addition to the greatest bending stress acting on the center of the bottom wall 13 and on the boundary section, the lifter body 2 is formed with the axial through-opening 6 and the annular groove 15, which generally reduce a mechanical strength of the lifter. As appreciated, this results in reduction rigidity of the lifter body 2 at and around the previously-noted boundary section between the lifter skirt section 14 and the lifter head section 3. To avoid this, the prior art lifter as disclosed in the Japanese Utility-Model Provisional Publication No. 57-200609 requires a thickness of the lifter head section 3 enough to bear the above-mentioned greatest bending stress, and as a whole the valve lifter cannot small-sized and light-weighted satisfactorily. Japanese Utility-Model Provisional Publication No. 60-164611 teaches providing two axially-extending central through-openings, respectively formed in the center of the valve-clearance adjusting shim and the center of the lifter head section, in place of oil passages, such as the annular oil groove 15 and the axial through-opening 6, formed near the outer periphery of the lifter head section. The lifter structure disclosed in the Japanese Utility-Model Provisional Publication No. 60-164611 cannot satisfy two contradictory requirements of the valve lifter, namely high rigidity and light weight, since the greatest bending moment acts in and around the center of the bottom wall of the lifter head section. Japanese Utility-Model Provisional Publication No. 59-170603 teaches boring axial through-openings (serving as oil-drain passages) substantially midway between the center and outer periphery of the valve-lifter head section, to prevent undesired floating phenomenon of a mechanical valve-clearance adjusting shim, which may take place owing to lubricating oil temporarily stored in the recessed portion of the lifter head section.

SUMMARY OF THE INVENTION

Accordingly, it is an object of the invention to provide a valve lifter for an internal combustion engine which avoids the aforementioned disadvantages of the prior art.

It is another object of the invention to improve a lubricating-oil passage structure of a valve lifter for an internal combustion engine, while satisfactorily balancing two contradictory requirements of the valve lifter, that is, high rigidity and light weight.

It is a further object of the invention to provide a valve lifter structure with a relatively thin-walled lifter head section in comparison with prior-art solid valve lifters with both a mechanical valve-clearance adjustment and lubricating-oil passages.

In order to accomplish the aforementioned and other objects of the present invention, a valve lifter for an internal combustion engine comprises a head section having a recessed portion on an upper face thereof, a skirt section formed integral with the head section and adapted to be in sliding-contact with a lifter guiding bore bored in an engine cylinder head, a mechanical valve-clearance adjusting shim accommodated in the recessed portion and adapted to be in contact with a cam on a camshaft, an annular groove formed in an upper face of a bottom wall of the recessed portion, a first through-opening formed in the shim to communicate with the annular groove, a second through-opening formed in the head section to communicate with the annular groove and to penetrate the head section, and the annular groove and the first and second through-openings being cooperative with each other for supply of lubricating oil on the shim to a contact area between a central boss-like portion formed in a lower face of the head section and an end of a valve stem, wherein the annular groove and the second through-opening are formed in an essentially zero bending moment area midway between a central axis of the head section and a peripheral wall of the recessed portion.

The annular groove and the second through-opening may be formed to be partly overlapped with the essentially zero bending moment area. It is preferable that the annular groove is formed in the essentially zero bending moment area to be coaxial with the central axis of the head section and a lowermost opening end of the first through-opening of the shim is completely opened into the annular groove. Preferably, a lowermost opening end of the second through-opening is opposed to an upper face of a valve-spring retainer attached to the valve stem. The first through-opening of the shim may consist of a plurality of through-openings penetrating the shim. It is more preferable that the first through-opening of the shim consists of at least one pair of axial through-openings being diametrically opposed to each other with respect to a central axis of the shim. Similarly, the second through-opening of the head section may consist of a plurality of through-openings penetrating the head section. It is more preferable that the second through-opening of the head section consists of at least one pair of axial through-openings being diametrically opposed to each other with respect to the central axis of the head section. Preferably, the central boss-like portion formed in the lower face of the head section is a substantially frusto-conical boss-like portion having a tapered surface raising moderately toward the central axis of the head section, and the second through-opening of the head section is opened into the tapered surface. Preferably, the annular groove formed in the bottom wall of the recessed portion is 0.1 mm or more in depth, from the viewpoint of lubricating performance.

DESCRIPTION OF THE PREFERRED EMBODIMENTS

Figure 1:
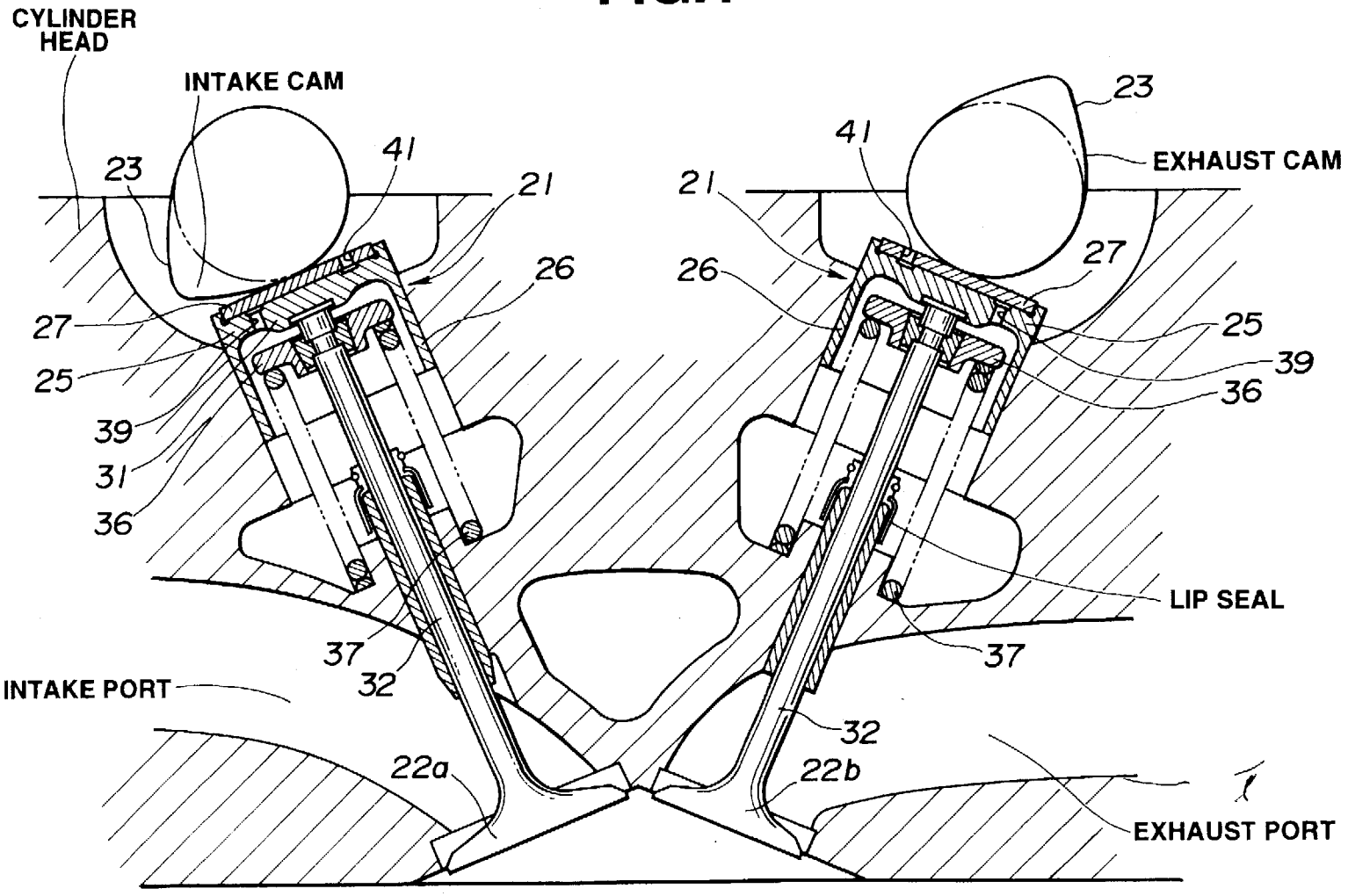
FIG. 1 is a cross-sectional view of a double-overhead-camshaft V-type engine with a valve lifter structure made according to the invention.
Figure 2:
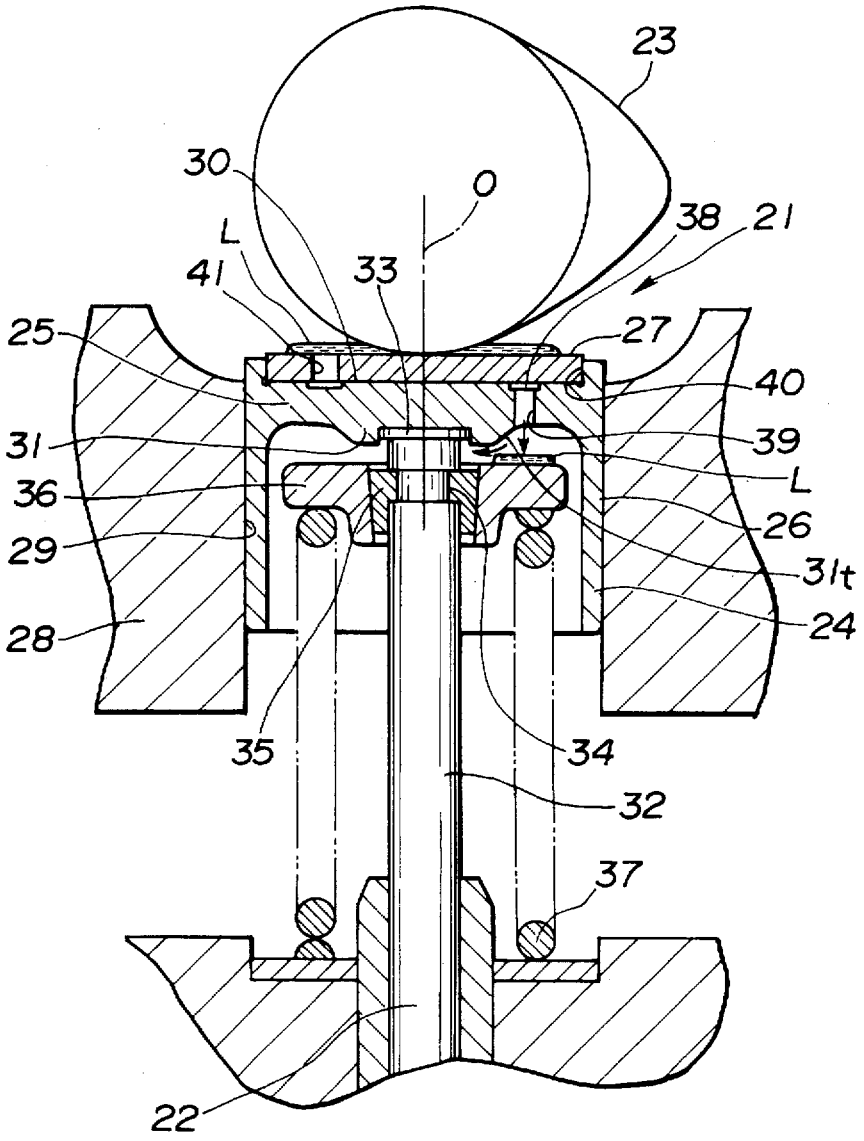
FIG. 2 is an enlarged cross-sectional view illustrating one embodiment of the valve lifter of the invention.
Figure 3:
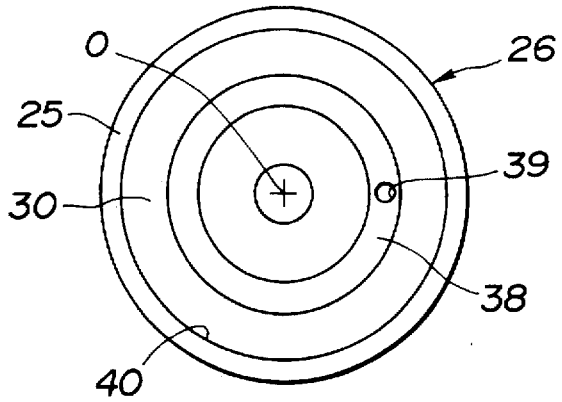
FIG. 3 is a top view illustrating the valve lifter of the embodiment shown in FIG. 2, under a condition wherein the valve-clearance adjusting shim is removed.
Figure 4:
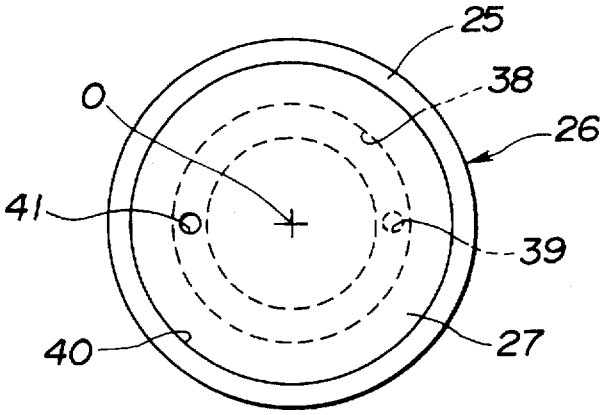
FIG. 4 is a top view illustrating the valve lifter of the embodiment shown in FIG. 2, under a condition wherein the valve-clearance adjusting shim is mounted on the lifter.
Figure 5:
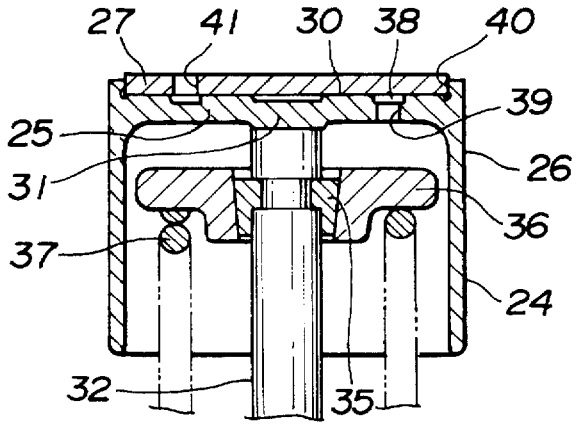
FIG. 5 is an enlarged cross-sectional view illustrating another embodiment of the valve lifter of the invention.

Referring now to the drawings, particularly to FIGS. 1 through 4, the valve lifter of the invention is exemplified in case of a double-overhead-camshaft V-type engine. Reference sign 21 denotes a mechanical valve lifter of the invention. The mechanical valve lifter, called a solid valve lifter, is interleaved between the valve stem 32 of an intake or exhaust valve 22 of an internal combustion engine and the cam 23 on the camshaft in the valve and gear mechanism. The valve lifter 21 consists of a substantially cylindrical lifter body 26 and a substantially disc-like mechanical valve-clearance adjusting shim 27. As best seen in FIG. 2, the lifter body 26 consists of an essentially cylindrical lifter skirt section 24 and a lifter head section 25 being formed integral with the lifter skirt section 24. The lifter body 26 is formed with a circular recessed portion 30 on the lifter head section 25. The circular recessed portion 30 serves as a mechanical valve-clearance adjusting shim pocket into which the shim 27 is fitted or put. The skirt section 24 of the lifter body is slidably guided at its outer peripheral surface by the inner peripheral wall surface of a cylindrical lifter-guiding bore 29 which is bored in the engine cylinder head 28. In order to enhance wearing resistance of the contacting surface of the shim 27 in contact with the cam 23, generally used is a hardened shim having both contacting surfaces hardened by way of hardening. The lifter body 26 is formed at the lower face of the lifter head section 25 with a substantially frusto-conical boss-like portion 31, simply abbreviated to a boss. The boss-like portion 31 has a tapered surface 31*t* in a manner so as to raise slightly moderately toward the central axis O of the lifter. The slightly-raised central portion of the boss 31 is engaged with the end of the valve stem 32. In the case of the valve lifter 21 of the embodiment shown in FIG. 2, a hardened pad member 33 is further press-fitted into a circular recessed portion formed in the slightly-raised central portion of the boss 31, in order to increase wearing resistance between the central portion of the boss 31 and the valve-stem end. Thus, when assembling, the valve lifter body 26 is brought into abutted-engagement with the valve stem through the pad member 33. In place of using such a hardened pad member 33, as shown in FIG. 5, the contacting surface of the boss 31 may be hardened by hardening process such as chill hardening.

The valve stem 32 is formed near the stem end with an annular spring-retainer lock groove 34 for a valve collet 35, serving as a valve-spring retainer lock. As seen in FIG. 2, the valve-spring retainer 36 is attached to the valve-stem end with the valve collet 35 fitted to the lock groove 34. The valve spring 37 is operatively disposed between the spring retainer 36 and the valve-spring seat (not numbered) fitted to the cylinder head. Thus, the spring bias of the valve spring 37 acts to permanently bias the end of the valve stem 32 toward the pad member 33 fitted to the boss of the lifter head section and thus the valve is biased in the valve open direction by the spring bias.

Figure 6A:
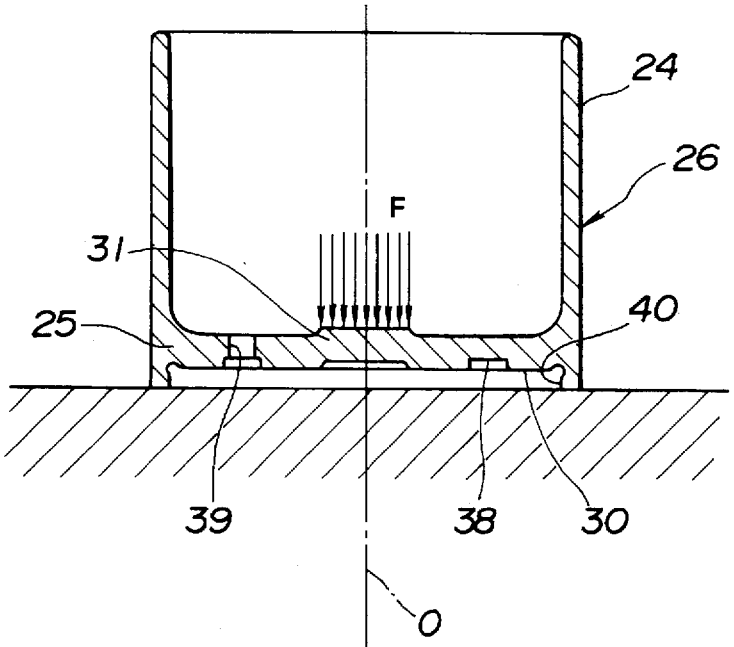
FIG. 6A is an explanatory view simply showing a state of the valve lifter body of the embodiment being acted upon by uniformly distributed load (denoted by F) extending over the central portion of the bottom wall of the lifter head section.
Figure 6B:
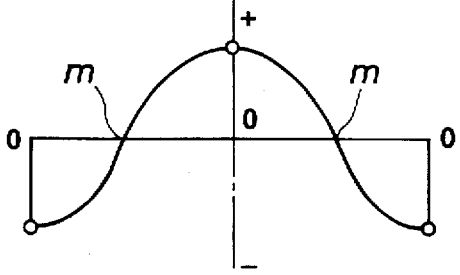
FIG. 6B is a bending-moment diagram of the lifter head section.
Figure 7:
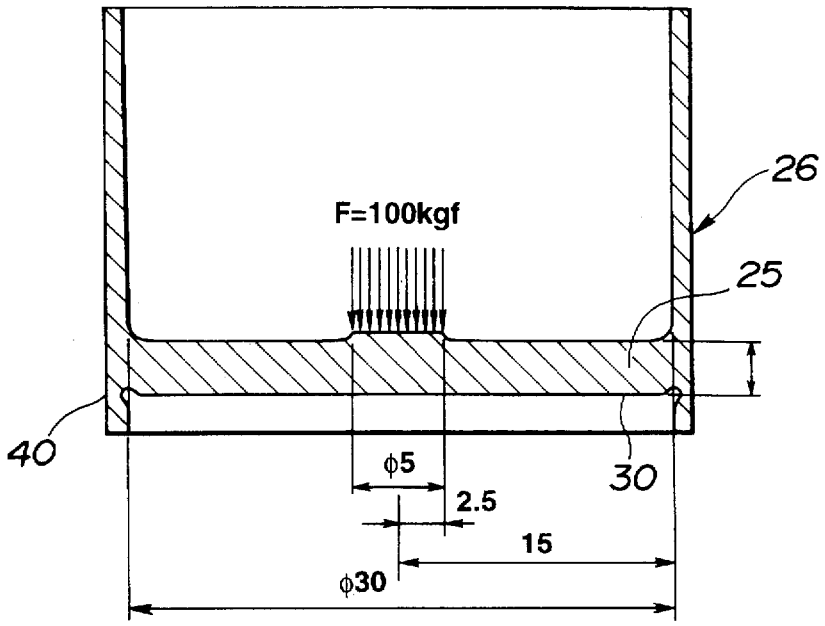
FIG. 7 is an enlarged cross-sectional view showing a simple model of statics, where input load F, acting on the central portion of the lifter bottom wall (the central boss of the lifter head section), is 100 kgf.
Figure 8:
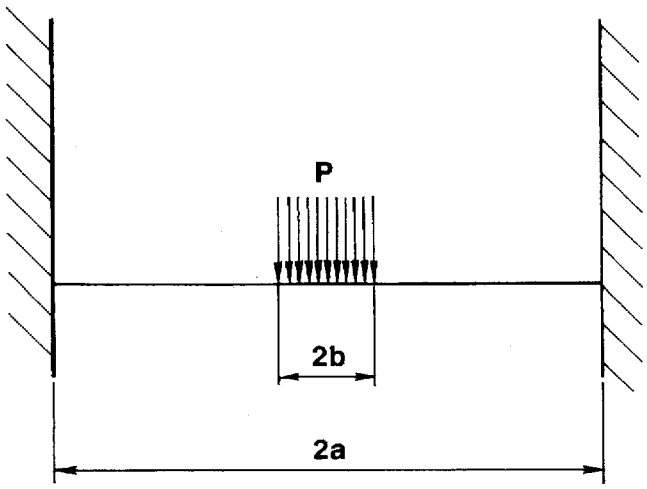
FIG. 8 is a more simplified statical model showing the valve-lifter head section indicated in terms of a flat disc plate fixed throughout its outer periphery and uniformly distributed load P acting on the central portion of the flat disc plate.

As seen in FIG. 2, the lifter head section 25 of the lifter body 26 is formed with a circumferentially extending annular oil groove 38 on the bottom wall of the recessed portion 30. The valve lifter body 26 is also formed with an axial through-opening 39 so that the axial through-opening 39 axially extends in the lifter head section 25 through a portion of the annular oil groove 38 to penetrate upper and lower surfaces of the lifter head section 25. Thus, some of lubricating oil L, fed to the cam journals and the cam 23 and then dropping onto the upper surface of the shim 27, is sent to the lower side of the lifter head section 25 through an axial through-opening 41, which is fully described later, the annular oil groove 38 and the through-opening 39. Note that, in case of the valve lifter of the embodiment, the annular groove 38 and the axial through-opening 39 are formed in the lifter head section 25 so that the centroid of the annular oil groove 38 and the center of the axial through-opening 39 are located in the coaxially-extending middle section between the central axial line O of the recessed portion 30 of the lifter body and the inner peripheral wall surface 40 of the recessed portion 30 (or the cylindrical lifter skirt section 24). There is less bending moment (or less bending stress) at the previously-described coaxially-extending middle section between the center axis O and the inner peripheral wall 40 of the recessed portion 30, as detailed later. That is, the valve lifter structure of the embodiment is designed so that the annular oil groove 38 and the axial oil passage or the axial through-opening 39 are formed at the circumferentially, coaxially-extending middle section at which there is zero bending moment acting upon the lifter head section 25. As appreciated from FIG. 6A, during the engine operation, the boss 31 of the lifter head section 25 is acted upon by reaction force F (regarded as distributed load uniformly distributed over the contacting surface of the boss) of the valve spring 37 through the valve-stem end and by a compression force applied from the cam 23 to the upper face of the lifter head section 25. FIG. 6B is the bending-moment diagram of the lifter head section under a condition of application of the reaction force F in the form of uniformly distributed load. As appreciated from the bending-moment diagram shown in FIG. 6B, the positive bending moment becomes greatest at the central axis O of the lifter head section 25, while the negative bending moment becomes greatest at the outer periphery of the lifter head section. On the other hand, there is zero bending moment (or zero bending stress) at the middle points m (or the circumferentially, coaxially-extending middle section between the center and outer periphery of the lifter head section. The middle points or the middle section m are identical with the milling position of the annular groove 38 and the boring position of the axial through-opening 39. The middle point m will be hereinafter referred to as a "zero bending-moment point". The zero bending-moment point m is obtained as follows, from the simple model of statics shown in FIG. 7. In FIG. 7, suppose the lifter head section 25 is almost uniform in thickness and having a thickness of 3 mm, the contacting surface of the boss-like portion 31 of the lifter head is 5 mm in diameter, the lifter head section 25 is 30 mm in diameter, and the input load F of 100 kgf is applied to the boss 31 (the central portion of the lifter head section 25) in the form of uniformly distributed load. As seen in FIG. 8, the statical model shown in FIG. 7 can be simplified as a statical model constructed by a flat disc plate fixed its outer periphery and uniformly distributed load acting on the center portion of the fixed flat disc plate. Considering the simplified statical model shown in FIG. 8, a bending stress σr is expressed as the following expressions (1) and (2).

In case of $0 \leqq r < b$:

$$\sigma_r = \mp \frac{3pb^2}{8h^2}\left\{(1+\nu)\left(\frac{b^2}{a^2}+4\cdot\ln\frac{a}{b}\right)-(3+\nu)\frac{r^2}{b^2}\right\} \quad (1)$$

In case of $b \leqq r < a$:

$$\sigma_r = \mp \frac{3pb^2}{8h^2}\left\{(1+\nu)\left(\frac{b^2}{a^2}+4\cdot\ln\frac{a}{r}\right)+(1-\nu)\frac{b^2}{r^2}-4\right\} \quad (2)$$

where, a denotes a radius of the inner peripheral wall surface 40 of the recessed portion 30 (or the cylindrical lifter skirt section 24), b denotes a radius of the central area imparted to the input load F, p denotes a load per unit area, h denotes the thickness of the fixed flat disc plate, ν denotes a Poisson's ratio, and ln denotes a natural logarithm.

Figure 9:
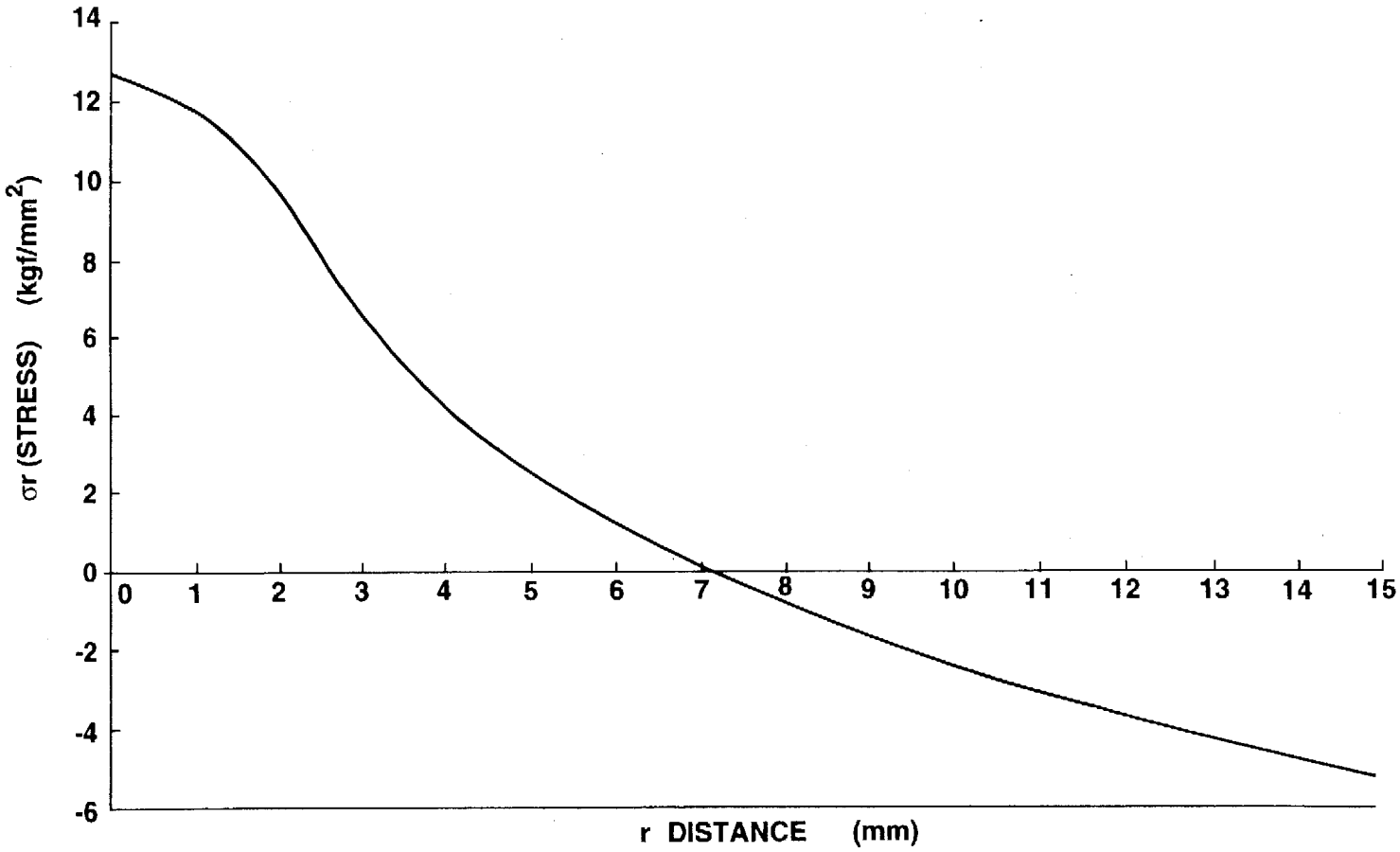
FIG. 9 is a graph illustrating a distance (r) versus bending stress ($\sigma r$) characteristic curve.

Referring to FIG. 9 there is shown the relationship between the distance (r) measured from the center of the lifter head section 25 and the bending stress (σr) acting upon it, where a=15 (mm), b=2.5 (mm), $p=F/\pi b^2=100/(\pi\cdot 2.5^2)=5.09(\text{kgf/mm}^2)$, and ν=0.3. As seen in FIG. 9, there is zero bending stress σr at middle points m of a distance r (=7 mm).

Figure 10:
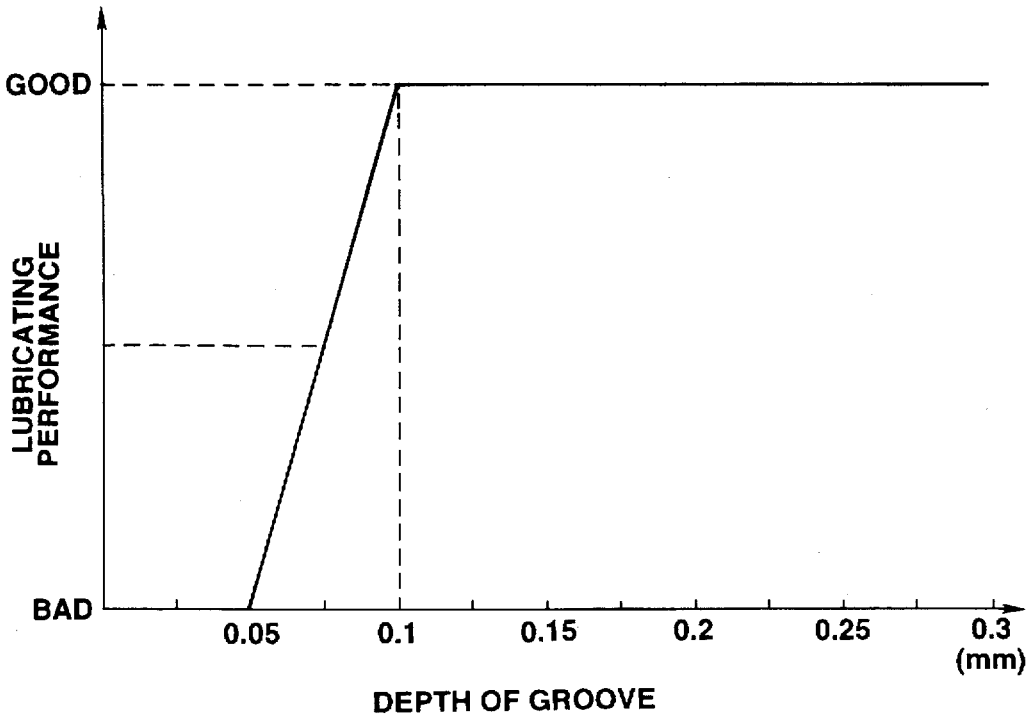
FIG. 10 is a graph showing the relationship between a depth of an annular groove formed in the valve-lifter head section and a lubricating performance.
Figure 11A:
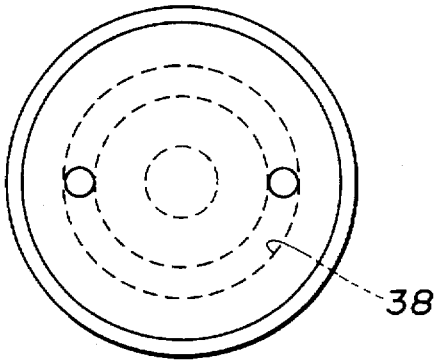
FIGS. 11A and 11B show a top view and an enlarged cross-sectional view, illustrating a modification of the valve lifter shown in FIG. 5.
Figure 12A:
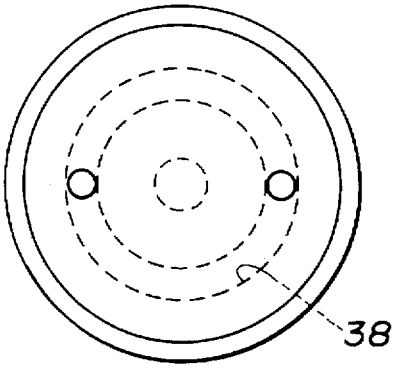
FIGS. 12A and 12B show a top view and an enlarged cross-sectional view, illustrating a modification of the valve lifter shown in FIG. 2.
Figure 11B:
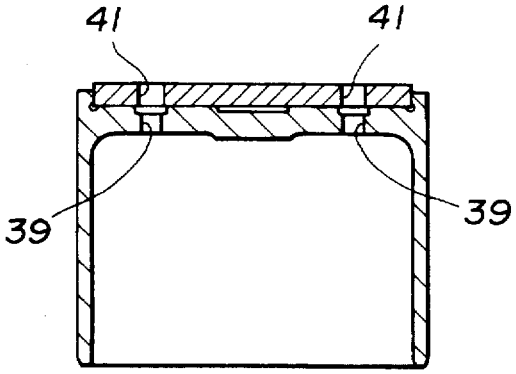
Figure 12B:
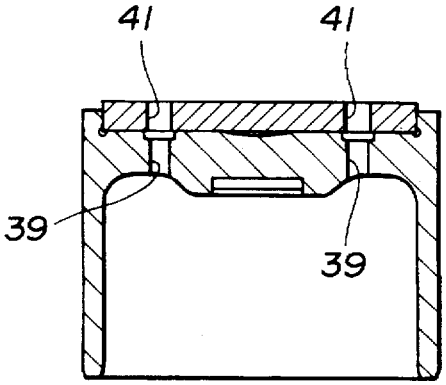
Figure 13:
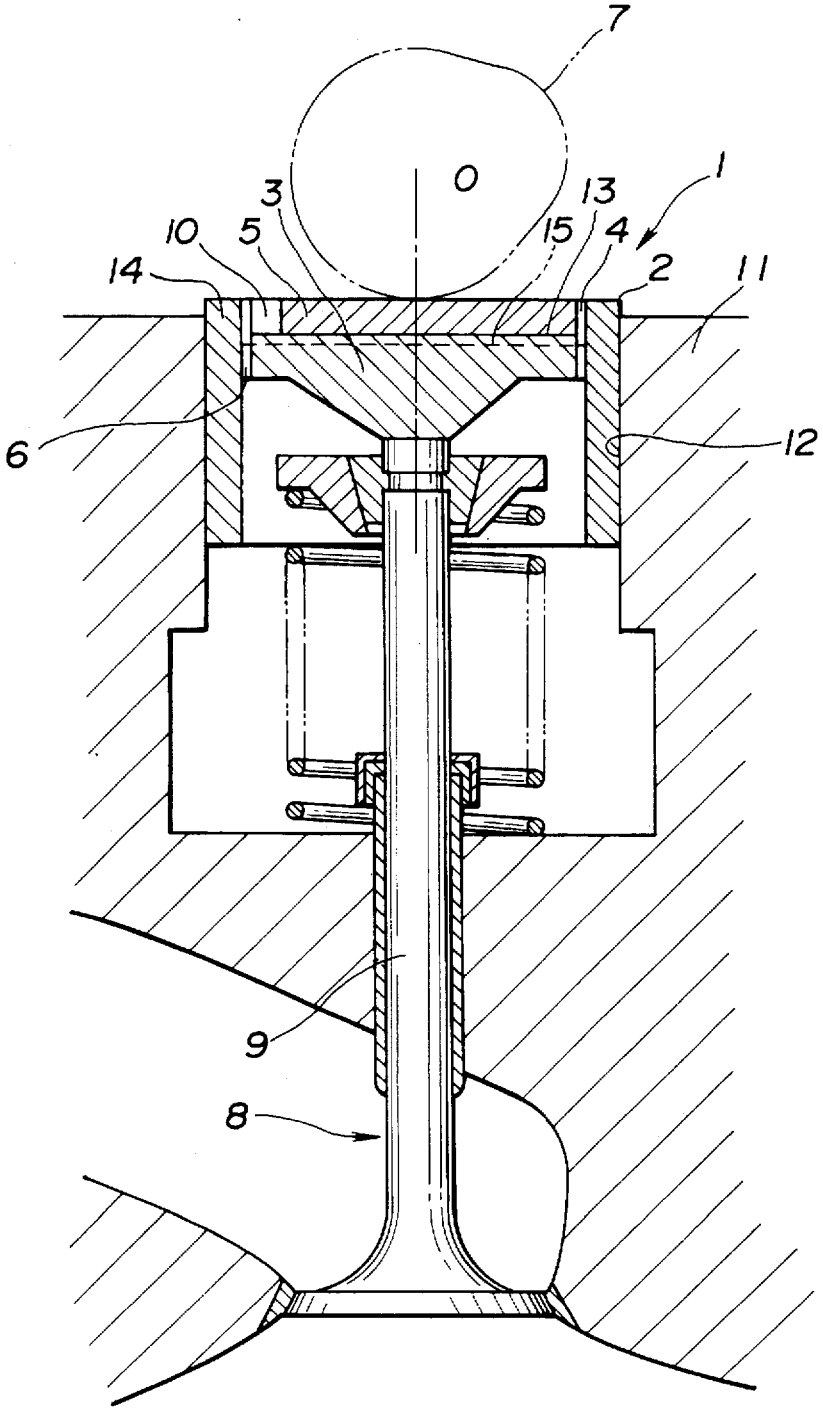
FIG.13 (PRIOR ART)
FIG. 13 is an enlarged cross-sectional view illustrating the prior art valve lifter.

Returning to FIG. 2, the mechanical valve-clearance adjusting shim 27 is formed with an axial through-opening 41 at a location corresponding to the previously-discussed circumferentially, coaxially-extending middle section at which there is zero bending moment acting upon the lifter head section 25. Thus, with the shim 27 fitted onto the recessed portion 30 of the lifter body 26, the axial through-opening 41 communicates with the axial through-opening 39 through the annular oil groove 38. With the previously-discussed arrangement, the lubricating oil on the upper surface of the shim 27 can be sent through the axial through-opening 41, the annular groove 39 and the axial through-opening 39 to the lower face of the lifter head section 25. As may be appreciated, the smaller the depth of the annular oil groove 38, the smaller the amount of lubricating oil sent from the upper side of the lifter head section to the lower side. For this reason, the actual depth of the annular groove 38 is determined on the basis of test results of the annular-groove depth versus lubricating performance characteristic shown in FIG. 10. The test results shown in FIG. 10 were ensured by the inventors of the present invention. As appreciated from the test result shown in FIG. 10, it is preferable that the depth of the annular groove 38 is 0.1 mm or more to insure adequate lubricating performance.

With the previously-described arrangement, the mechanical valve lifter according to the invention operates as follows.

During the engine operation (during rotation of the cam 23), the cam 23 pushes down the shim 27 of the valve lifter 21 against the bias of the valve spring 37, and then opens and closes the intake or exhaust valves 22. The pushing-down load of the cam 23 is transmitted from the valve lifter 21 to the valve 22 through the contacting surfaces, namely the central portion of the boss 31 of the lifter body 26 and the end of the valve stem 32. At the same time, lubricating oil L, dropping onto the upper surface of the shim 27 after delivery from the engine lubrication system to the cam journals and the cam on the camshaft and then, is efficiently supplied to the lower side of the lifter head section 25 to provide oil film between the contacting surface of the boss 31 and the valve-stem end. That is, the lubricating oil L on the shim 27 is adequately sent from the axial through-opening 41 of the shim 27 through the annular groove 38 and the axial through-opening 39 to the lower face of the lifter head section 25. Some of the lubricating oil sent from the upper side of the lifter head section 25 to the lower side flows from the lowermost opening end of the through-opening 39 via the tapered surface 31*t* of the substantially frusto-conical boss 31 to the contact area between the contacting surface of the boss 31 and the valve-stem end. In the shown embodiments, since the lowermost opening end of the axial through-opening 39 is opened into the tapered surface 31*t* of the boss 31, the oil is effectively supplied through the through-opening 39 via the tapered surface 31*t* to the contact area between the boss 31 (or the pad member 33) and the valve-stem end. As indicated by the arrow in FIG. 2, the remainder of lubricating oil sent to the lifter-head lower surface drops down onto the upper face of the valve-spring retainer 36, since the lowermost end of the through-opening 39 is opened to be opposed to the upper face of the spring retainer 36. During the engine operation, the spring retainer 36 repeatedly moves up and down together with the valve stem 32 with rotation of the cam 23, the oil on the spring retainer 36 is scattered or splashed upwards in the form of fine particles, and thus supplied to the contact area between the valve-stem end and the boss 31. Also, a portion of the oil on the shim 27 can be supplied through a slight aperture defined between the shim 27 and the recessed portion 30 to the annular groove 38. During the engine operation, the shim 27 tends to rotate about the axis O of the valve lifter owing to rotational motion of the cam 23. Since the distance between the through-opening 41 of the shim and the axis O of the lifter, the radius of the annular groove 38 with respect to the O axis of the lifter, the distance between the through opening 39 of the lifter head section 25 and the O axis are identical to each other, the two through-openings 41 and 39 can be permanently communicated with each other through the annular groove 38, irrespective of rotation of the shim 27 about the O axis, during operation.

According to the valve lifter structure of the embodiments, since the lubricating-oil passages are provided at the previously-explained coaxially-extending middle section in which there is less bending moment, a bending stress acting on the area nearing the oil passages, that is, the annular passage 38 and the through-opening 39, can be effectively reduced or minimized during the engine operation. As comparing with prior art solid valve lifters, a wall thickness of the lifter head section 25 can be thinned without sacrificing high rigidity and high durability, thereby, as a whole, small-sizing or light-weighting the valve-lifter assembly.

As previously discussed, it is preferable that the annular groove 38 is formed in the lifter body for example by way of milling and the through-opening 39 is formed in the lifter body for example by way of drilling so that the location of these oil passages 38 and 39 is identical to the zero-bending moment point m. Alternatively, the oil passages 38 and 39 may be formed in such a manner as to be partly overlapped with the zero-bending moment point m in order to provide almost the same effect as the embodiments previously explained.

Referring now to FIGS. 11A, 11B, 12A and 12B, there are shown modifications of the valve lifters shown in FIGS. 5 and 2. In the modified valve lifter structure shown in FIGS. 11A through 12B, the shim is formed with a plurality of through-openings 41 (preferably a pair of diametrically-opposing axial through-openings 41), whereas the lifter head section is formed with a plurality of through-openings 39 (preferably a pair of diametrically-opposing axial through-openings 39), to attain a more effective supply of lubricating oil to the contact area between the boss 31 (or the pad member 33) and the valve-stem end.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A valve lifter for an internal combustion engine, comprising:

a head section having a recessed portion on an upper face thereof;

a skirt section formed integral with said head section and adapted to be in sliding-contact with a lifter guiding bore bored in an engine cylinder head;

a mechanical valve-clearance adjusting shim accommodated in said recessed portion and adapted to be in contact with a cam on a camshaft;

an annular groove formed in an upper face of a bottom wall of said recessed portion;

a first through-opening formed in said shim to communicate with said annular groove;

a second through-opening formed in said head section to communicate with said annular groove and to penetrate said head section; and said annular groove and said first and second through-openings being cooperative with each other for supply of lubricating oil on said shim to a contact area between a central boss-like portion formed in a lower face of said head section and an end of a valve stem;

wherein said annular groove and said second through-opening are formed in an essentially zero bending moment area midway between a central axis of said head section and a peripheral wall of said recessed portion.

2. A valve lifter as claimed in claim 1, wherein said annular groove and said second through-opening are formed to be partly overlapped with said essentially zero bending moment area.

3. A valve lifter as claimed in claim 1, wherein said annular groove is formed in said essentially zero bending moment area to be coaxial with the central axis of said head section, and a lowermost opening end of said first through-opening of said shim is completely opened into said annular groove.

4. A valve lifter as claimed in claim 1, wherein said second through-opening is formed in said head section so that a lowermost opening end of said second through-opening is opposed to an upper face of a valve-spring retainer attached to said valve stem.

5. A valve lifter as claimed in claim 1, wherein said first through-opening of said shim consists of a plurality of through-openings penetrating said shim.

6. A valve lifter as claimed in claim 1, wherein said first through-opening of said shim consists of at least one pair of axial through-openings being diametrically opposed to each other with respect to a central axis of said shim.

7. A valve lifter as claimed in claim 1, wherein said second through-opening of said head section consists of a plurality of through-openings penetrating said head section.

8. A valve lifter as claimed in claim 1, wherein said second through-opening of said head section consists of at least one pair of axial through-openings being diametrically opposed to each other with respect to the central axis of said head section.

9. A valve lifter as claimed in claim 1, wherein said central boss-like portion formed in the lower face of said head section is a substantially frusto-conical boss-like portion having a tapered surface raising moderately toward the central axis of said head section, and said second through-opening of said head section is opened into said tapered surface.

10. A valve lifter as claimed in claim 1, wherein said annular groove formed in the bottom wall of said recessed portion is 0.1 mm or more in depth.

* * * * *